US005755624A

United States Patent [19]

Helmstetter

[11] Patent Number: 5,755,624

[45] Date of Patent: May 26, 1998

[54] SELECTIVELY BALANCED GOLF CLUB HEADS AND METHOD OF HEAD SELECTION

[75] Inventor: Richard C. Helmstetter, Carlsbad, Calif.

[73] Assignee: Callaway Golf Company, Carlsbad, Calif.

[21] Appl. No.: 580,479

[22] Filed: Jan. 22, 1996

[51] Int. Cl.[6] ..... A63B 53/04

[52] U.S. Cl. ..... 473/291; 473/345; 473/349; 473/409

[58] Field of Search ..... 473/334, 335, 473/337, 344, 345, 350, 409, 287, 291, 349; 273/171, 172, 167 A, 167 F, 167 H, 77 A

[56] References Cited

U.S. PATENT DOCUMENTS

| | | | |
|---|---|---|---|
| 1,269,745 | 6/1918 | Robertson | 473/344 |
| 3,976,299 | 8/1976 | Lawrence et al. | 473/327 |
| 4,059,270 | 11/1977 | Sayers | 473/409 |
| 4,313,607 | 2/1982 | Thompson | 473/344 |
| 4,971,321 | 11/1990 | Davis | 473/287 |
| 5,193,805 | 3/1993 | Solheim | 473/291 |
| 5,251,901 | 10/1993 | Solheim et al. | 473/338 |
| 5,294,037 | 3/1994 | Schmidt | 228/125 |
| 5,301,945 | 4/1994 | Schmidt | 473/346 |
| 5,310,186 | 5/1994 | Karsten | 473/345 |
| 5,351,953 | 10/1994 | Mase | 473/289 |

FOREIGN PATENT DOCUMENTS

| | | |
|---|---|---|
| 210023 | 7/1993 | Taiwan . |
| 218119 | 12/1993 | Taiwan . |
| 253201 | 8/1995 | Taiwan . |
| 266486 | 12/1995 | Taiwan . |

*Primary Examiner*—Sebastiano Passaniti
*Assistant Examiner*—Stephen L. Blau
*Attorney, Agent, or Firm*—William W. Haefliger

[57] ABSTRACT

A golf club head comprising a shell having toe and heel portions; a front wall defining a forward facing ball-striking face; and top and bottom walls, the bottom wall being metallic and having at least one local zone of relatively greater thickness, remaining extent of the bottom wall having thickness substantially less than the local zone of relatively greater thickness.

36 Claims, 10 Drawing Sheets

Fig 1

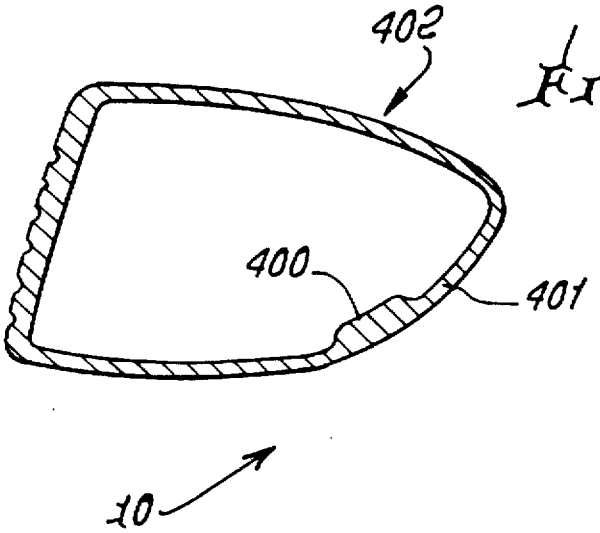
FIG. 3.
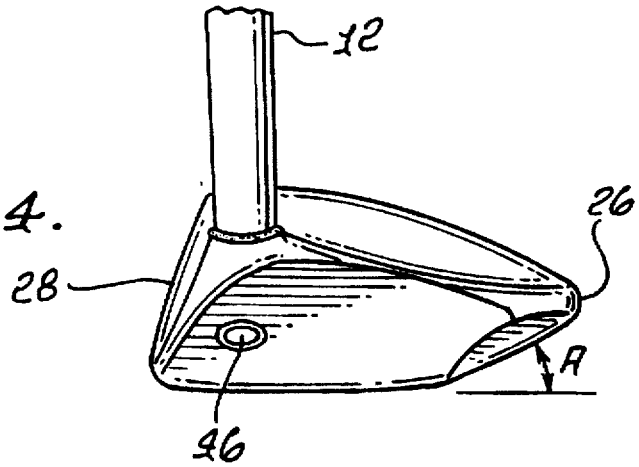
FIG. 4.
FIG. 5.
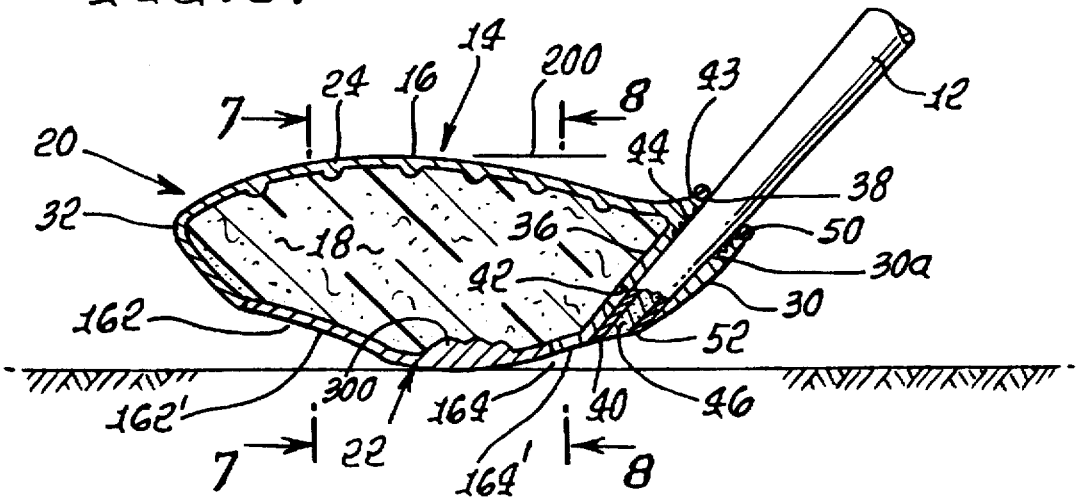

FIG. 10.
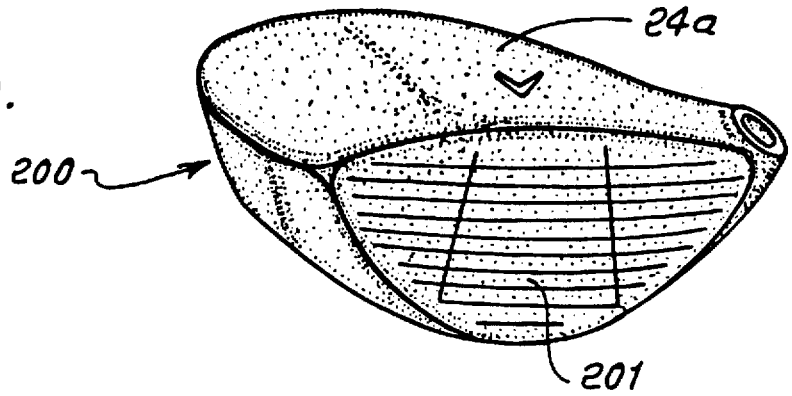
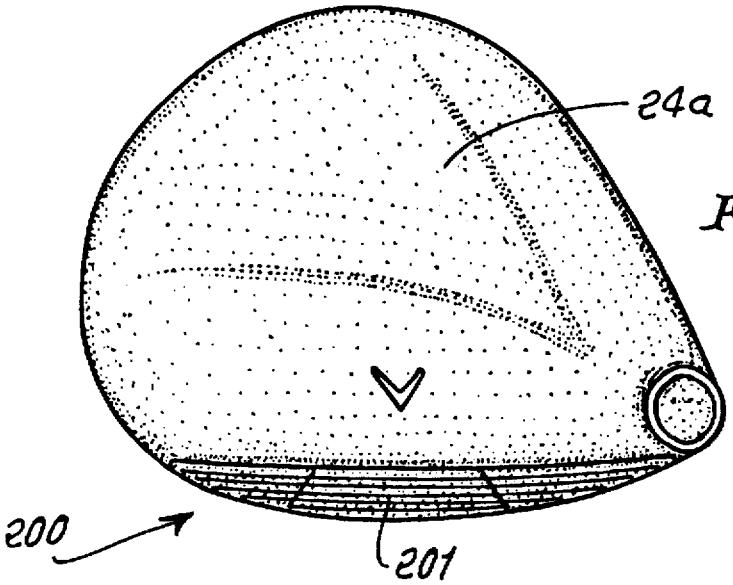
FIG. 11.
FIG. 12.
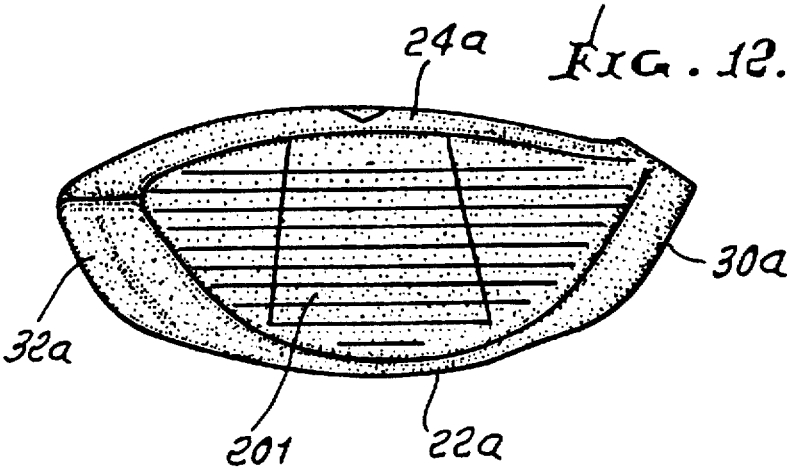

FIG. 32.
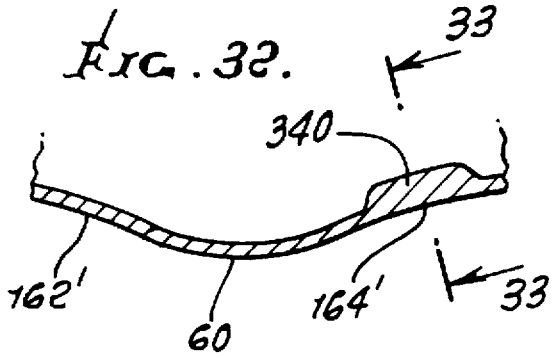
FIG. 35.
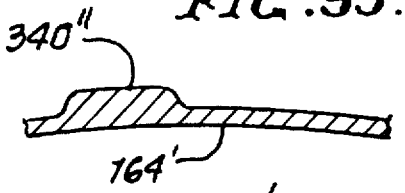
FIG. 33.
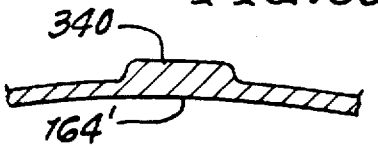
FIG. 34.
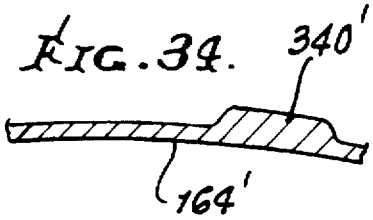
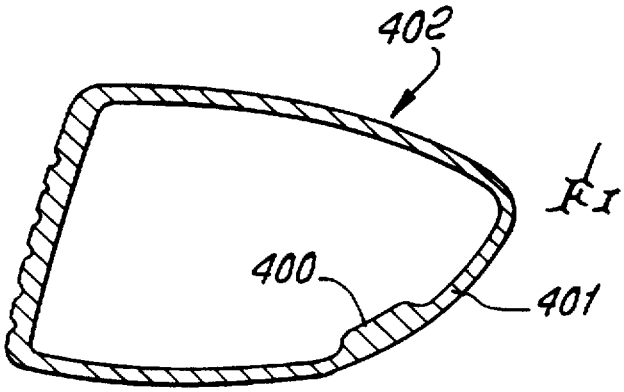
FIG. 36.
FIG. 38.
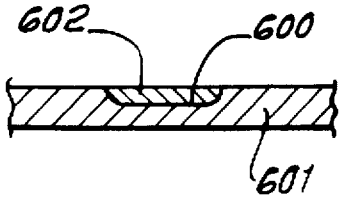
FIG. 37.
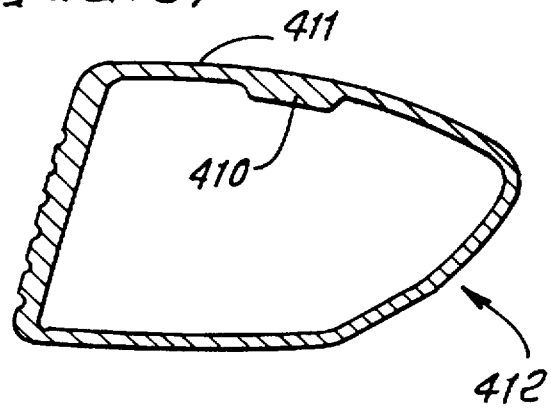

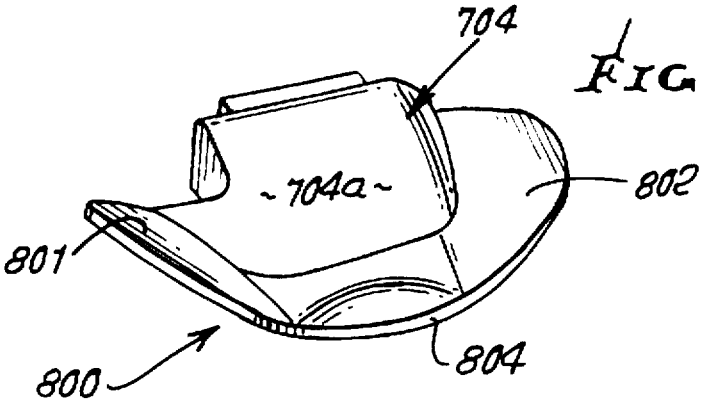
FIG. 41.
FIG. 42.
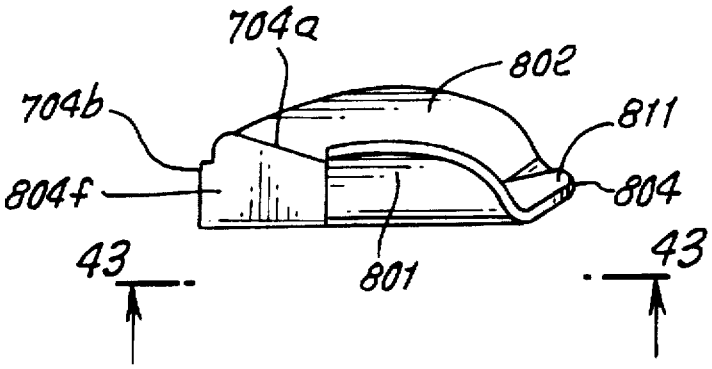
FIG. 43.
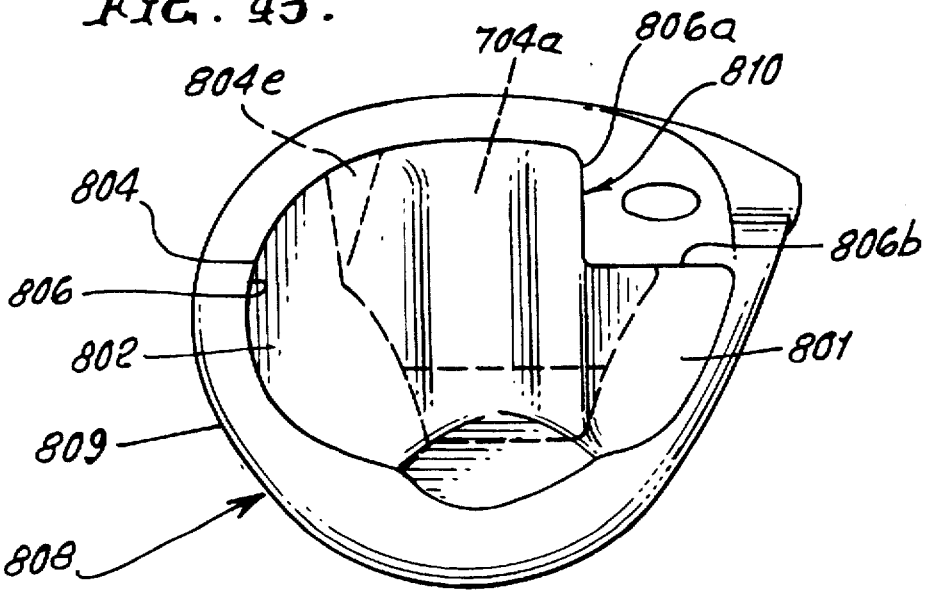

SELECTIVELY BALANCED GOLF CLUB HEADS AND METHOD OF HEAD SELECTION

BACKGROUND OF THE INVENTION

This invention relates generally to controlled balance of golf club heads, as for example static and/or dynamic balance; and more particularly it concerns provision of selective local integral weighting of golf club heads such as metal woods to control or achieve desired balance of a head or different heads, as in a set of metal wood golf clubs. The invention has particular reference to golf club heads wherein shallow cavities are provided in the head bottom wall, between a medial ridge and the head heel and toe, although the invention is not limited to heads of that configuration.

Proper balancing of golf clubs, and particularly golf club heads, to meet the needs of golfers having different stances and/or arm or shaft swing characteristics, as for a selected shaft connected to the head, is a highly desirable and important objective. There is need for an improved golf club head configuration that will achieve this objective, and particularly for golf club heads in a set, wherein the different numbered heads are selectively configured or tailored to meet the golfer's needs.

SUMMARY OF THE INVENTION

It is a major object of the invention to provide a golf club head configuration, and multiple head selective configurations, that meet the above needs of different golfers.

Basically, the invention is incorporated in an improved head comprising a metal shell having toe and heel portions, a front wall defining a forward facing ball-striking face, and top and bottom walls, the bottom wall being metallic, the bottom wall having at least one local zone of relatively greater thickness, remaining extent of the bottom wall having thickness substantially less than said relatively greater thickness of the local zone. Such a local zone of increased thickness shifts the head center of gravity in accordance with its position and to the player's advantage, as can be determined by try-out of the club.

As will be seen, the major extent of the bottom wall and the thicker local zone typically consist of a one-piece casting, so that no separate attachment of a weight to the bottom wall is required; also, the local zone is typically at least about twice as thick as the thickness of the major areal extent of the bottom wall. The areal size of the thicker local zone may vary as from about ¼ square inch to about 1 square inch. The thickness of the local zone typically exceeds 0.150 inch, whereas the thickness of the remainder of the bottom wall is less than 0.060 inch.

The head bottom wall may have a medial ridge which projects downwardly, and the bottom wall forming two shallow recesses, one recess between the ridge and said heel portion, and the other recess between the ridge and said toe portion. The local zone of increased thickness is then typically associated with the ridge and/or one or both recesses. Examples of such a head bottom wall configuration with a ridge and recesses are described in U.S. Pat. No. 5,301,945 and in U.S. patent application Ser. No. 08/173,389, incorporated herein by reference. The location of the local zone of increased thickness at the wall portion forming the bottom ridge, or at the wall portion forming one of the shallow recesses, has the further advantage that such wall portion or portions are thereby strengthened, to resist shock loading imposed by impact of the bottom wall with a hard ground surface, or imposed as a result of front wall striking of a golf ball, at high velocity.

As will be appreciated, the local zone of increased wall thickness may be provided on one or more club head walls other than the bottom wall; and the bottom wall need not have the ridge and recess configuration referred to, but may have other configurations, which may be undulating, in which event the location of the local zone of greater thickness at or near the undulation tends to strengthen the undulating wall as against shock loading. In any event, the local zone of increased thickness tends to shift the head center of gravity relative to what or where it would otherwise be in the absence of that local zone.

Finally, and as will be seen, the provision of variably selectively locally weighted heads, as described, as in a set of clubs, enables the golfer to select each club head in his set to have a differentially shifted center of gravity best suited for his swing and stance characteristics, for each particular club in his set. Such a set may include two or more of the following, wherein local selectively thickened wall zones are incorporated:

a) a metal wood having a front face inclined at approximately 9° from vertical, b) a metal wood having a front face inclined at approximately 11° from vertical, c) a metal 2 wood, d) a metal 4 wood, e) a metal 5 wood.

A still further object is to provide an improved golf club head, and method of forming same, to incorporate improvements in construction, mode of operation and results, as referred to.

These and other objects and advantages of the invention, as well as the details of an illustrative embodiment, will be more fully understood from the following specification and drawings, in which:

DRAWING DESCRIPTION

FIG. 3 is an elevational view of the toe end of the FIG. 1 head;

FIG. 4 is an elevational view of the heel end of the FIG. 1 head;

FIG. 5 is an elevation taken in section on lines 5—5 of FIG. 2 and showing a local zone of increased wall thickness at a bottom wall ridge, in accordance with the invention;

FIG. 10 is a perspective view showing the top, front and toe regions of a known golf club driver head having 9° front face inclination and into which the invention may be incorporated;

FIG. 11 is a top plan view of the FIG. 10 head;

FIG. 12 is a front face elevation view of the FIG. 10 head;

Figure 17:
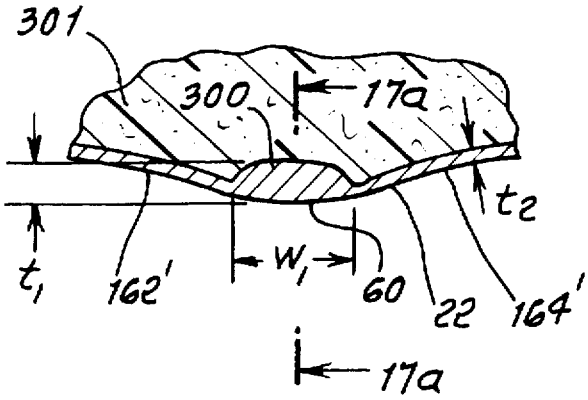
FIG. 17 is a fragmentary section corresponding to the full section as seen in FIG. 5, and showing a local zone of increased thickness located at the center of the bottom wall ridge of a metal wood head.
Figure 19:
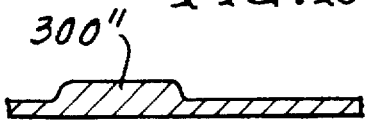
Figure 17A:
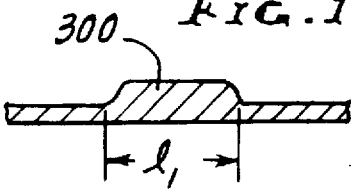
Figure 18:
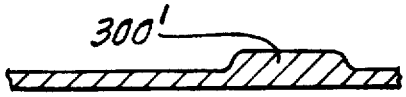
Figure 20:
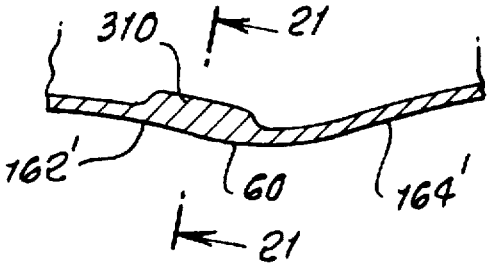
Figure 21:
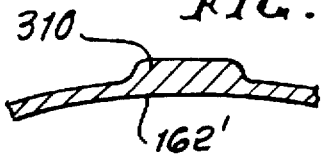

FIG. 17*a* is a fragmentary view taken in front to rear section on lines 17*a*—17*a* of FIG. 17;

FIGS. 18 and 19 are views like FIG. 17, but showing the local zone of increased thickness shifted forwardly and rearwardly, respectively;

FIG. 20 is a view like FIG. 17, but showing the local zone of increased thickness shifted laterally to lie at least in part on the bottom wall portion that forms one concave recess (toward the toe);

FIG. 21 is a section like FIG. 17, and taken on lines 21—21 of FIG. 20.

Figure 6:
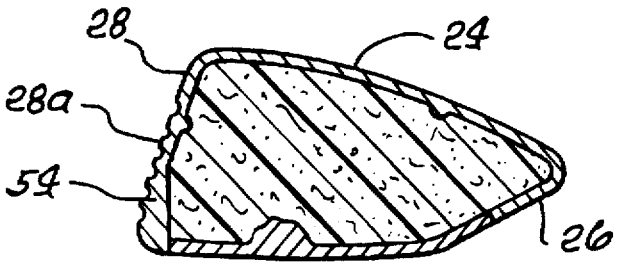
FIG. 6 is an elevation taken in section on lines 6—6 of FIG. 2.
Figure 7:
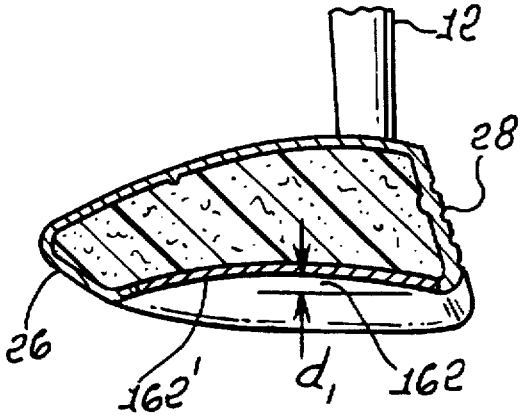
FIG. 7 is an elevation taken in section on lines 7—7 of FIG. 5.
Figure 8:
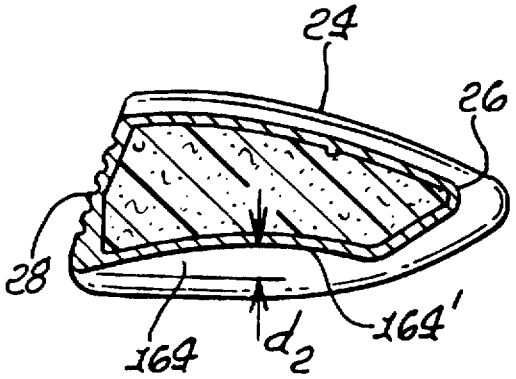
FIG. 8 is an elevation taken in section on lines 7—7 of FIG. 5.
Figure 9:
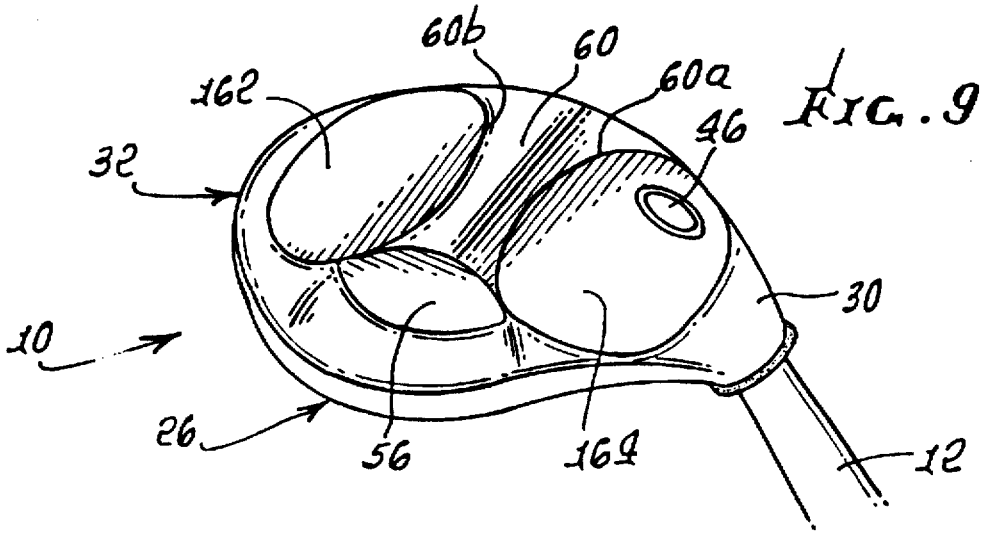
FIG. 9 is a perspective view showing the bottom, rear, and heel end of the FIG. 1 club head.
Figure 23:
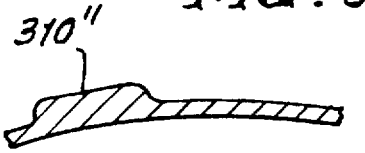
Figure 22:
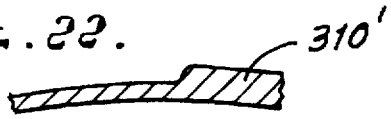
Figure 24:
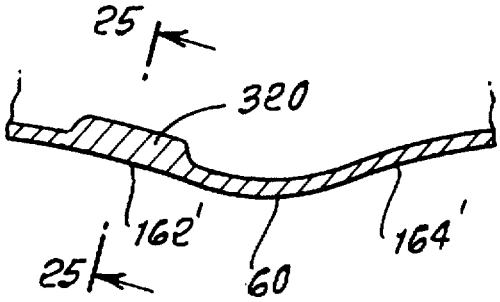
Figure 27:
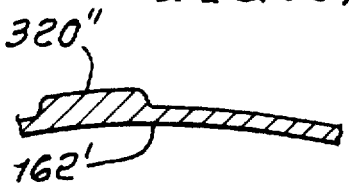
Figure 25:
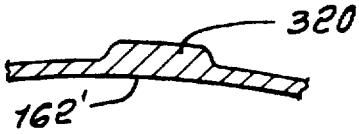
Figure 26:
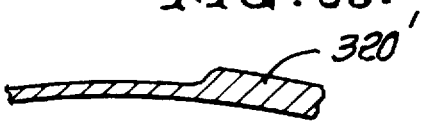
Figure 28:
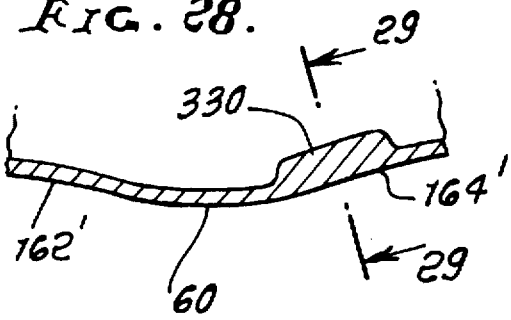
Figure 31:
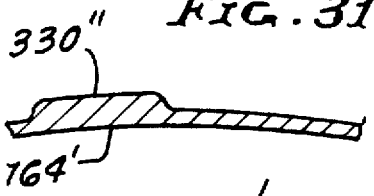
Figure 29:
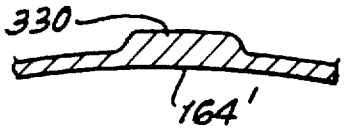
Figure 30:
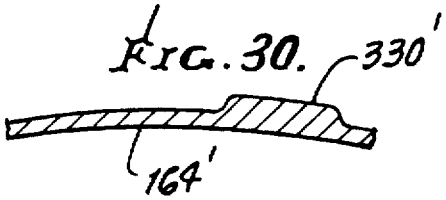
Figure 39A:
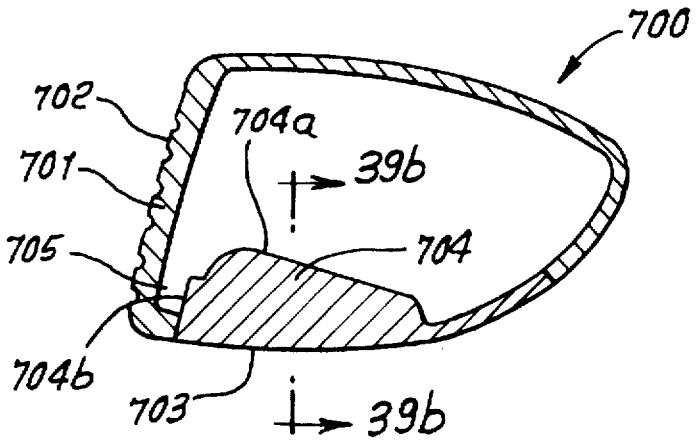
Figure 39B:
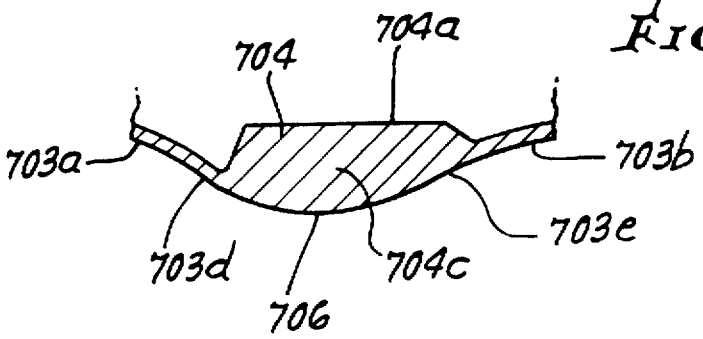
Figure 40:
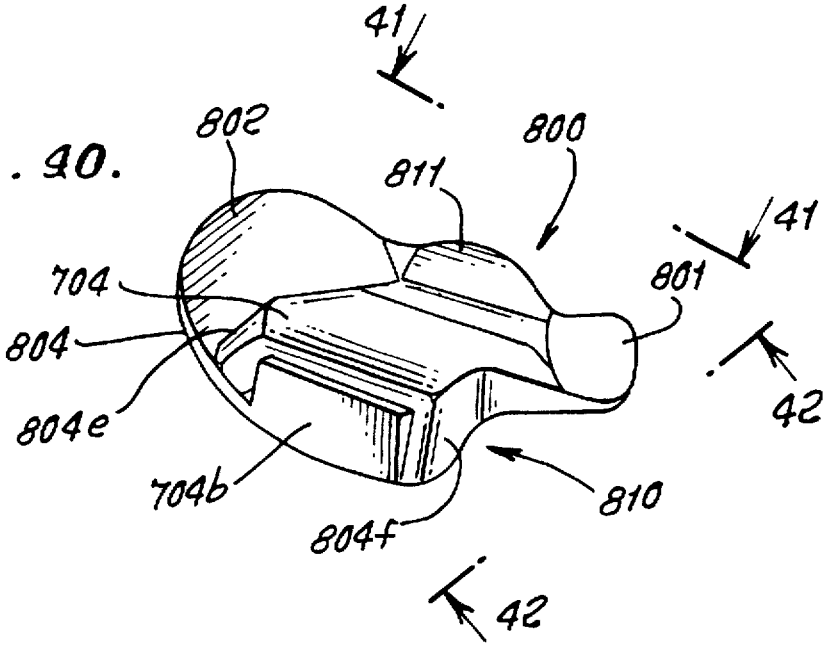

FIGS. 22 and 23 are views like FIG. 21, but showing the local zone of increased thickness shifted forwardly and rearwardly, respectively;

FIG. 24 is a view like FIG. 20, but showing the local zone of increased thickness shifted further laterally toward the toe, to lie wholly on the bottom wall portion that forms said one concave recess;

FIG. 25 is a section like FIG. 21, and taken on lines 25—25 of FIG. 24;

FIGS. 26 and 27 are views like FIG. 25, but showing the local zone of increased thickness shifted forwardly and rearwardly, respectively;

FIG. 28 is a view like FIG. 17, but shows the local zone of increased thickness shifted laterally to lie at least in part on the bottom wall portion that forms another concave recess (toward the heel);

FIG. 29 is a section like FIG. 17*a*, and taken on lines 29—29 of FIG. 28;

FIGS. 30 and 31 are views like FIG. 29, but showing the local zone of increased thickness shifted forwardly and rearwardly, respectively;

FIG. 32 is a view like FIG. 28, but showing the local zone of increased thickness shifted further laterally toward the heel of the head, to lie wholly on the bottom wall portion that forms said other concave recess;

FIG. 33 is a section taken on lines 33—33 of FIG. 32;

FIGS. 34 and 35 are views like FIG. 33, but showing the local zone of increased thickness shifted forwardly and rearwardly, respectively;

FIG. 36 is a view like that of FIG. 6, and showing the local zone of increased thickness located at the rear wall of a head;

FIG. 37 is a view like that of FIG. 6, and showing the local zone of increased thickness located at the upper wall of a head;

FIG. 38 is an enlarged section;

FIG. 39(*a*) is a fragmentary section taken through a golf club head front wall and through a sole plate, showing selective weighting of the head in closely spaced relation to the rear side of the front wall;

FIG. 39(*b*) is a section taken on lines 39(*b*)—39(*b*) of FIG. 39(*a*);

FIG. 40 is a right front to left rear top perspective view of a sole plate embodying frontal selective weighting of the type disclosed in FIGS. 39(*a*) and 39(*b*);

FIG. 41 is a rear-to-front top perspective view taken on lines 41—41 of FIG. 40;

FIG. 42 is a left side elevation taken on lines 42—42 of FIG. 40; and FIG. 43 is a bottom plan view taken on lines 43—43 of FIG. 42.

DETAILED DESCRIPTION

Referring now to FIGS. 1–5, a golf club 10, of known outer configuration (see U.S. Pat. No. 5,301,945) is shown. The present invention is applied to that head, as better shown in FIG. 5, and FIGS. 22–24. The club 10 includes a shaft 12 (only the lower portion of which is shown), which is attached to a head 14. The head 14 is in the configuration of a "wood" club, although it is made of metal.

As shown in FIGS. 5–8, the head comprises a hollow, metal shell 16, and may consist of stainless steel; and it may be fabricated by the "lost wax" casting method that is well-known in the art. The shell 16 may for example be formed in two pieces: a main portion 20 and a sole plate 22, that is peripherally welded to the main portion 20.

Figure 1:
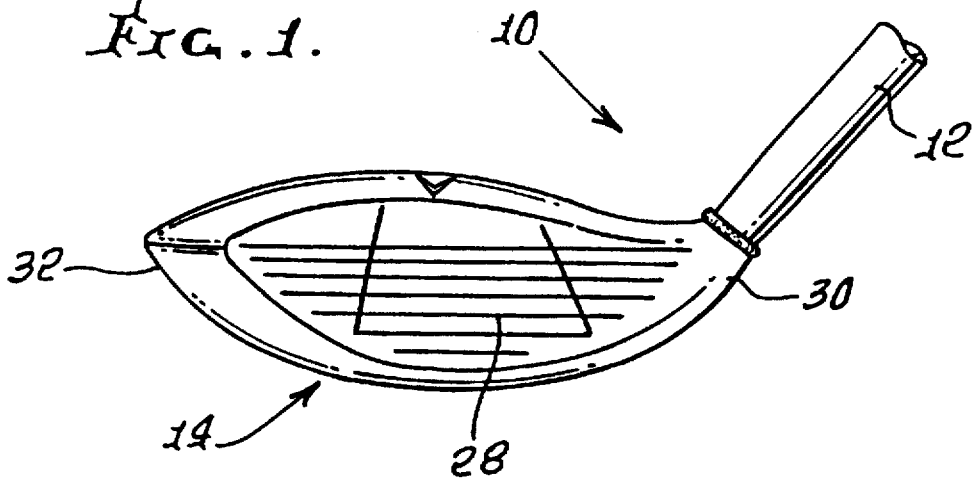
FIG. 1 is a front elevational view of a known golf club head into which the invention may be incorporated.
Figure 2:
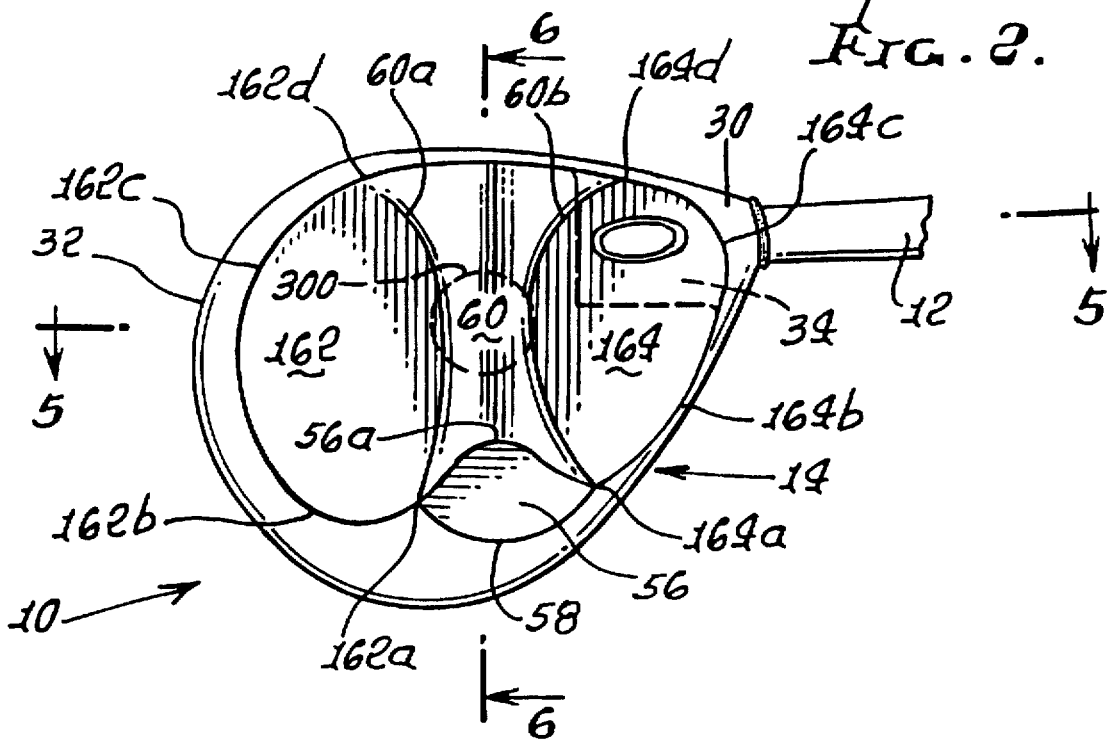
FIG. 2 is a plan view of the bottom of the FIG. 1 head.

The main shell portion 20 has a top surface 24, a rear surface 26, and a ball-striking surface or face 28 opposite the rear surface 26. The face 28 is angled with respect to the vertical with a specified "pitch" that is determined by the type of club and the amount of loft desired. The end portion of the head 14 proximate the shaft 12 is commonly termed the "heel" 30, while the end portion opposite the heel 30 is termed the "toe" 32. As shown in FIG. 2, the face 28 is typically curved from the heel 30 to the toe 32.

FIGS. 5 and 6 show incorporation of a weight 300 on the sole plate, at the head interior. Specifically, the weight 300 is shown incorporated with the inner side of downwardly convex ridge 60 that extends forwardly and rearwardly, as seen in FIG. 2. Such weighting will be described in detail in FIGS. 22–24, as well as in FIGS. 25–42.

To complete the description of FIGS. 5–9, shell 16 has a heel wall 30*a*, a hollow tube 36 having an upper opening 38 in top surface 24, and a lower opening 40 in head bottom surface as shown. If foam material is to be introduced into the head interior, it may be passed through an orifice 42 in tube 36. Tube 36 receive shaft 12, to which it is suitably connected. See also lip 43, ring 50, and striations 44. The head top surface is tangent to horizontal plane 200. The lower end 52 of shaft 12 is plugged at 46.

As seen in FIG. 2, shallow downwardly concave recesses are formed at 162 and 164 by the sole plate, at opposite sides of the ridge. Recess 162 merges with one side of the ridge and has peripheral extent indicated at 162*a*, 162*b*, 162*c* and 162*d*. Recess 164 merges with the opposite side of the ridge 60 and has peripheral extent indicated at 164*a*, 164*b*, 164*c* and 164*d*. Note recess medial surface extents 162' and 164'. The recess depths are indicated at $d_1$ and $d_2$ in FIGS. 7 and 8. Ridge 60 diverges forwardly at 60*a* and 60*b*, and rearwardly toward rear bevel 56. The latter is bounded by lines 56*a*, 58, and cusps at 162*a* and 164*a*. See bevel angle A in FIG. 4. See also the weight 300 in FIG. 2, located medially along the ridge length.

The head bottom wall can be formed or cast integrally with the remainder of the head, if desired, i.e., it need not be separately formed and later welded to a rim defined by a separately cast head. Such forming may be by a casting or molding process employing metallic or non-metallic material.

The bottom wall and/or the rest of the head can be made of materials other than metal. Typical metallic materials include steel, steel alloy, titanium, and titanium alloy.

Referring now to FIGS. 10–16, the metal wood head 200 shown has a front face 201 with inclination β from vertical (see FIG. 14) which is 9°, i.e., the wood is a driver.

The internal construction of the head 200 may, if desired, be the same as that of the FIG. 1–9 head, as respects selective weighting as described herein.

Figure 13:
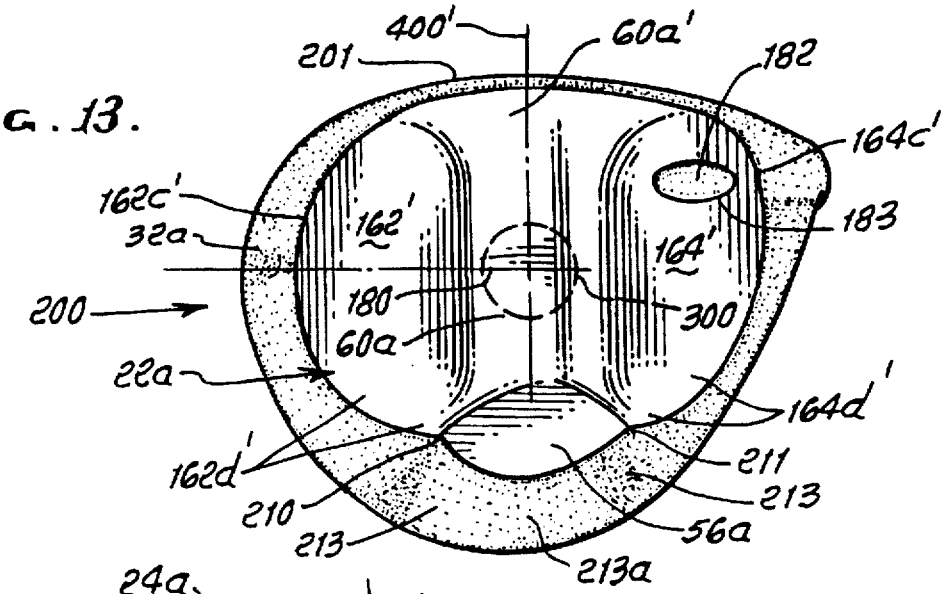
FIG. 13 is a bottom plan view of the FIG. 10 head.
Figure 14:
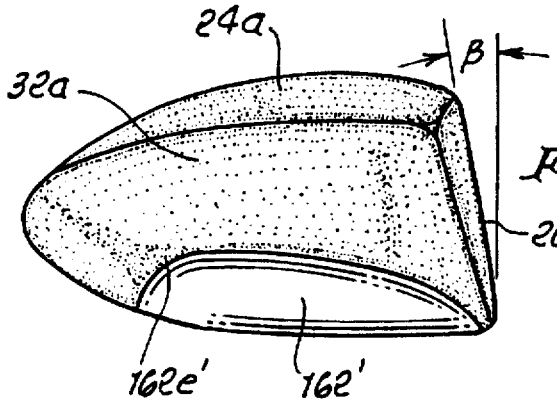
FIG. 14 is a toe end elevation view of the FIG. 10 head.
Figure 15:
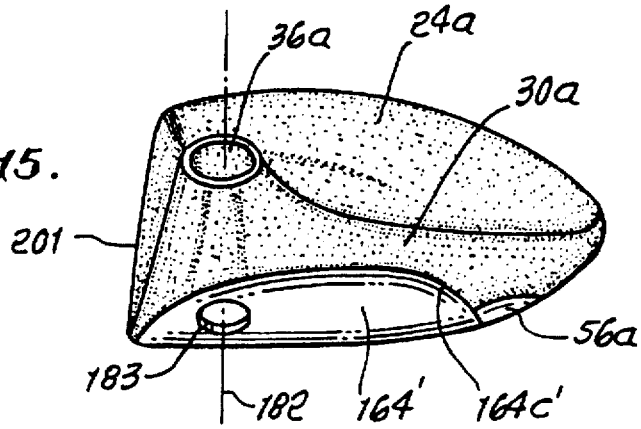
FIG. 15 is a heel end elevation view of the FIG. 10 head.
Figure 16:
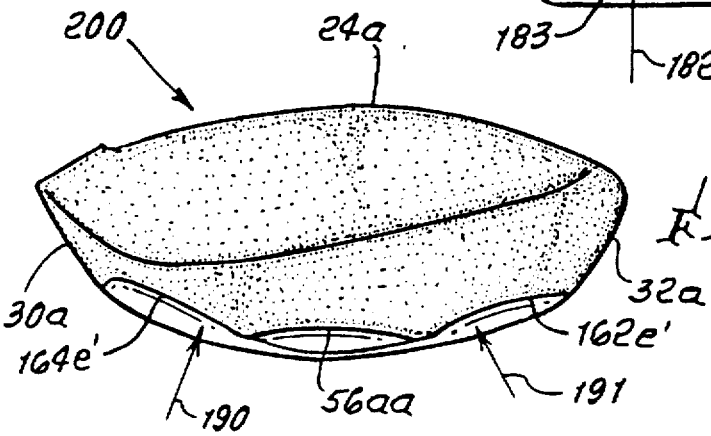
FIG. 16 is a rear elevation view of the FIG. 10 head.

Referring to FIG. 13, the head 200 is further characterized by the following:

i) the dished recesses 162' and 164' are located in substantially mirror imaged position with respect to a forwardly extending, vertical plane 400' bisecting the ridge 60*a'*, ii) the convergent rearward terminus of dished recess rearwardmost extent 162*d'* is intersected by a cusp 210 defined by surface or bevel 56*a;* and the convergent rearward terminus of dished recess rearwardmost extent 164*d'* is intersected by a cusp 211 also defined by bevel 56*a*. These cusps are further defined by intersection of the bevel with head rounded outer bottom surface 213 and intersection of the bevel with the ridge rearwardmost and rearwardmost divergent extents, as shown. The cusps 210 and 211 are substantially equidistant from the head front face 201, whereby the bevel is centered between the rearwardmost extents 162*d'* and 164*d'* of the recesses, iii) plane 400 also bisects the bevel so that cusps 210 and 211 are located at substantially equal distances from the plane; and the plane 400 also intersects the rearwardmost extent 213*a* of the head. Note the ridge 60*a* is divergent, forwardly.

Note the selective locations of an internal weight as described herein, and as designated in broken lines at 300. See also FIGS. 5, 17 and 17*a*.

In FIGS. 5, 17 and 17*a*, the head cast metallic bottom wall, in this core sole plate 22, has a local zone 300 of relatively greater metallic thickness $t_1$, associated with ridge 60, which is downwardly convex. The major extent of the bottom wall 22 has thickness as at $t_2$ substantially less than such thickness $t_1$. Thicker local zone 300 bulges upwardly toward the interior 301 of the cast metallic head, to form a plateau, and is shown to have lateral width $w_1$, and longitudinal length $l_1$. The thickness $t_1$ is typically at least about twice the thickness $t_2$, and $t_1$ typically exceeds 0.150 inch, whereas the thickness $t_2$ of the major extent of the bottom wall is normally less than 0.060 inch. In an example, the thicknesses are as follows:

$$0.150<t_1<0.500 \text{ inch}$$

$$0.030<t_2<0.050$$

Note that the local zone 300 provides selectively located increased weighting, so that its position influences the location of the head center of gravity relative to the head heel and toe, the head top and bottom, and the head forward face, and rear wall. Zone 300 may be at the approximate center of the bottom wall; and cast integrally with the bottom wall, or the sole plate 22.

In FIG. 18, the local zone indicated at 300' is like zone 300, but is shifted forwardly along the interior of the ridge, to shift the head center of gravity forwardly. In FIG. 19 the local zone is indicated at 300" and is like zone 300, but is shifted rearwardly, along the interior of the ridge, to shift the head center of gravity rearwardly.

In FIGS. 20 and 21 the local zone 310 is like zone 300, but shifted toward the toe of the head; it is located at least partly above the recessed wall portion 162' at the toe side of the ridge, to shift the CG toward the toe. In FIG. 22 the local zone 310' is like zone 310 and laterally in the same position as 310, but it is shifted forwardly, and in FIG. 23 zone 310" is shifted rearwardly.

In FIGS. 24 and 25, local zone 320 is like zone 300, but shifted further toward the toe of the head. It is located above the recessed wall portion 162', and shifts the CG more toward the toe. In FIG. 26 the local zone 320' is like zone 320 (and is in the same laterally shifted position as zone 320) but it is shifted forwardly; and in FIG. 27 zone 320" is shifted rearwardly, to correspondingly shift the CG rearwardly.

In FIGS. 28 and 29, local zone 330 is like zone 300, but is here shifted toward the heel of the head. It is located at least partly above the recessed wall portion 164' at the heel side of the ridge, to shift the CG toward the heel. In FIG. 30 the local 330' is like zone 330, but is shifted forwardly, and in FIG. 31 corresponding local zone 330" is shifted rearwardly.

In FIGS. 32 and 33, local zone 340 is like zone 330 but shifted further toward the heel of the head. It is located above the second wall portion 164', and shifts the CG more toward the heel. In FIG. 34 local zone 340' is shifted forwardly; and in FIG. 35, corresponding local zone 340" is shifted rearwardly, to shift the CG rearwardly:

By way of example, trial metal heads bearing a number X (say a 2 wood) would have a selected local thicker zone positioned as in FIGS. 17 and 18, 20 and 21, 24 and 25, 28 and 29, and 32 and 33, and a golfer would try out such X heads to determine which are best suited to his stance and swing. If he selected the FIGS. 24 and 25 head for best lateral shifted CG, he would then try out the heads of FIGS. 26 and 27 for best longitudinal shifted CG. He might then select the X head having local weighting as in FIG. 27, as representing, for him or her, the best "balanced" X head of the group.

The golfer would then repeat this selection from a similar group of X-1 heads, i.e. 1 woods for example; and for a similar group of X+1 heads, i.e. 3 woods. The golfer then can select which weighted head is best "balanced" or suited for him or her, for a series of heads in a set, and purchase or lease such "tailored" heads as representing the set of heads best balanced for him or her. If the golfer's stance, or swing, or selected shaft changes, the matching method can be repeated to arrive at a different set which is up-dated and balanced (statically and dynamically) for the golfer, whereby the golfer's game score can be significantly improved, over time.

More specifically, the method of selecting golf clubs to make up a set would include providing a first group of golf clubs of the same front face "loft" angularity (as for example 3 woods), but whereby the local zones of increased thickness have different selected positions in the heads of the group (as in FIGS. 17–33, for example); then swinging those different heads of the first group on a try-out basis; and then selecting a club of the first group having an apparent best balance for that particular golfer. The best 3-wood would thereby be selected. Next, a second group of golf clubs would be provided, of the same front face angularity different from that of the first group (as for example 2-woods), but wherein the local zones of second thickness again have different selected positions in the heads of the second group (as in FIGS. 17–33, for example); then swinging those different heads of the second group on a try-out basis; and then selecting a club of the second group having an apparent best balance for that particular golfer. The best 2-wood would thereby be selected. This process would be repeated for all woods of a complete set.

FIG. 36 shows an alternative formation of a local zone 400, of increased thickness in the lower rear wall 401 of a metal wood head 402; and FIG. 37 shows alternative formation of a local zone 410 on the upper wall 411 of a metal wood head 412.

FIG. 38 shows provision of a local zone of decreased thickness, i.e. a recess or pocket 600 in the metallic bottom wall 601 of a head, instead of a zone of inward thickness as described above. Such a local zone of decreased thickness may be substituted for the zone of increased thickness as referred to in FIGS. 17–37. Suitable lightweight filler material 602 may be filled into that recess, to strengthen the wall at that location. One example is epoxide material.

Referring to FIGS. 39(*a*) and 39(*b*), a head 700, which may be of the type shown in FIGS. 10–16, has a front wall 701 defining a ball-striking face 702, and a bottom wall 703. The bottom wall has a local zone 704 of selected thickness characterized in this instance in that it increases in thickness forwardly toward the front wall 701. See upwardly and leftwardly (frontwardly) ramping upper surface 704*a*. The remaining extent, as at 703*a* and 703*b* of the bottom wall has thickness different from the selected thickness. Also, note the gap or clearance 705 between the front wall 701 and the forward wall 704*b* of the body 704. The shape of the weight body 704 places the head CG closer to the front wall 701, and to the lower extent thereof, for enhanced ball striking effect.

Note in FIG. 39(*b*) that the bottom wall 703 diverges laterally oppositely and upwardly, at shallow upward angles, away from a bottom ridge 706 that extends rearwardly, as in FIG. 13. Note that the body 704 increases in thickness laterally, toward the region 704*c* vertically above the ridge. Bottom wall 703 also forms downwardly concave surfaces 703*d* and 704*e*, corresponding to recesses 162' and 164' in FIG. 13.

The sole plate 800 in FIGS. 40–43 embodies the features as referred to in FIGS. 39(*a*) and 39(*b*), and corresponding elements bear the same identifying numerals. Note that the sole plate has lateral wings 801 and 802 which diverge upwardly and laterally. See corresponding elements 703*a* and 703*b* in FIG. 39(*b*). Body 704 merges with the wings, as with their upper surfaces, as appears in FIG. 41. The sole plate has a peripheral ledge 804, which is adapted for weld connection to the looping inner edge 806 of the bottom wall of the head 808, as seen in FIG. 43. The head periphery is indicated at 809.

An inner "cut-out" 810 is formed on the sole plate periphery to fit against the corresponding head protruding edges 806*a* and 806*b*, for weld connection thereto. Sloping lateral faces of the body 804 appear at 804*e* and 804*f*. Rear upturned beveled surface 811 corresponds to bevel 56*a* in FIG. 13.

I claim:

1. A golf club head comprising a shell having toe and heel walls, a front wall defining a forward facing ball-striking face, and top and bottom walls, at least one of said walls having a local zone of selected thickness, remaining extent of said one wall having thickness different from said selected thickness, said shell being hollow and wherein said bottom wall is characterized as having a medial ridge which projects downwardly, and as forming two shallow recesses, one recess between the ridge and said heel portion, and the other recess between the ridge and said toe portion, said local zone having inward thickness relatively greater than the thickness of said one wall over its major remaining extent, and said local zone offset toward a selected recess, said local zone being an inward extension of said one wall and being of unitary mass, the local zone being provided such that the head center of gravity is able to be selectively located forwardly and rearwardly and also in the lateral and vertical directions therewith, said local zone entirely contained within said head.

2. The head of claim 1 wherein said one wall and said local zone consist of a one-piece metal casting.

3. The head of claim 1 wherein the thickness of said local zone is at least about twice the thickness of said remaining extent of said one wall.

4. The head of claim 3 wherein said thickness of said local zone exceeds 0.150 inch, and said thickness of said remaining extent of said one wall is less than 0.060 inch.

5. The head of claim 3 wherein said thickness of said local zone is between 0.150 and 0.250 inch, and said thickness of said remaining extent of said one wall is between 0.030 and 0.050 inch.

6. The head of claim 5 wherein said one wall comprises said bottom wall.

7. The head of claim 1 wherein said one wall is said bottom wall.

8. The head of claim 1 wherein said local zone is located rearwardly of said front wall.

9. The head of claim 1 wherein said local zone of relatively greater thickness faces interiorly of the head.

10. The head of claim 1 wherein said local zone forms a plateau projecting interiorly of the head.

11. The head of claim 1 wherein said local zone defines a pocket on said one wall.

12. The head of claim 11 including filler material in said pocket.

13. The head of claim 1 wherein said local zone increases in thickness in a direction toward said front wall.

14. The head of claim 13 wherein said one wall comprises said bottom wall.

15. The head of claim 14 wherein said bottom wall comprise a head sole plate peripherally joined to a looping rim defined by the head.

16. The head of claim 15 wherein said local zone has an upper surface which ramps upwardly toward said front wall.

17. The head of claim 16 wherein said upper surface terminates in rearwardly spaced relation from said front wall.

18. The head of claim 13 wherein said local zone has an upper surface which ramps upwardly toward said front wall.

19. The head of claim 18 wherein said upper surface terminates in rearwardly spaced relation from said front wall.

20. A golf club head comprising a shell having a hollow interior and having metallic toe and heel walls, a front wall defining a forward facing ball-striking face and top and bottom metallic walls, said bottom wall having at least one local zone of relatively greater thickness, the major extent of said bottom wall having thickness substantially less than said relatively greater thickness, said local zone protecting into said hollow interior, said bottom wall and local zone of increased thickness being of unitary mass, the local zone being provided such that the head center of gravity is able to be selectively located forwardly and rearwardly and also in the lateral and vertical directions.

21. The head of claim 20 wherein said major extent of said bottom wall and said local zone consist of a one-piece integral metallic body.

22. The head of claim 21 wherein said body is a metallic casting.

23. The head of claim 20 wherein the thickness of said local zone is at least twice the thickness of said bottom wall.

24. The head of claim 23 wherein said thickness of said local zone exceeds 0.150 inch, and said thickness of said major extent of said bottom wall is less than 0.060 inch.

25. The head of claim 23 wherein said thickness of said local zone is between 0.150 and 0.250 inch, and said thickness of said major extent of said bottom wall is between 0.030 and 0.050 inch.

26. The head of claim 20 wherein said bottom wall is characterized as having a medial ridge which projects downwardly, and as forming two shallow recesses, one ridge between the ridge and said heel wall, and the other recess between the ridge and said toe wall, said at least one local zone of increased thickness being positioned in such relation to said ridge and recesses as to shift the head center of gravity relative to what it would otherwise be with respect to said ridge and recesses in the absence of said local zone.

27. The head of claim 26, including other like heads defining a set of golf clubs having heads with different front face angularities.

28. The set of golf clubs as defined in claim 27, wherein said local zones of increased thickness have different selected positions in at least some of the heads of the set.

29. The head of claim 20, including other like heads defining a set of golf clubs having heads with different front face angularities.

30. The set of golf clubs as defined in claim 29, wherein said local zones of increased thickness have different selected positions in at least certain of the heads of the set.

31. The method of selecting golf clubs to make up a set, each golf club including a head comprising a shell having a hollow interior and having metallic toe and heel walls, a front wall defining a forward facing ball-striking face and top and bottom metallic walls, said bottom wall having at least one local zone of relatively greater thickness, the major extent of said bottom wall having thickness substantially less than said relatively greater thickness, said local zone projecting into said hollow interior, said bottom wall and local zone of increased thickness being of unitary mass, the local zone being provided such that the head center of gravity is able to be selectively located forwardly and rearwardly and also in the lateral and vertical directions, and which includes providing a first group of golf clubs wherein the local zones have different selected positions in the heads of the group, all heads of the group having the same front face angularity, swinging the different heads of the group, and selecting a club of the first group as desired, based on said swinging.

32. The method of claim 31 including providing a second group of said golf clubs, but wherein the local zones of increased thickness have different selected positions in the heads of the second group, all heads of the second group having the same front face angularity which is different from the front face angularity of the heads of the first group, swinging the different heads of the second group, and selecting a club of the second group as desired, based on said swinging thereof.

33. The method of providing a set of golf clubs for a golfer that includes the steps:

a) providing multiple groups of golf clubs wherein
   i) the heads of each group are the same except that the locations of the head centers of gravity are different in the heads of each group,
   ii) the heads of different groups have front faces with different angularities, b) and allowing the golfer to swing the clubs of each group and to select a club for each group which is best suited for that golfer, c) each head provided to comprise a shell having a hollow interior and having metallic toe and heel walls, a front wall defining a forward facing ball-striking face and top and bottom metallic walls, said bottom wall having at least one local zone of relatively greater thickness, the major extent of said bottom wall having thickness substantially less than said relatively greater thickness, said local zone projecting into said hollow interior, said bottom wall and local zone of increased thickness being of unitary mass, the local zone being provided such that the head center of gravity is able to be selectively located forwardly and rearwardly and also in the lateral and vertical directions.

34. A golf club head comprising a hollow shell having toe and heel walls, a front wall defining a forward facing ball-striking face, and top and bottom walls, said bottom wall having a local zone of selected thickness, remaining extent of said bottom wall having thickness different from said selected thickness, said local zone increasing in thickness in a direction toward said front wall, said local zone having an upper surface which ramps upwardly toward said front wall, to provide increasing thickness, said upper surface terminating in rearwardly spaced relation from said front wall, and wherein said local zone terminates, frontwardly, at a gap defined between said front wall and the forwardmost extent of said local zone, wherein said local zone of increasing thickness is spaced rearwardly from said front wall, said local zone and said bottom wall being of unitary mass, the local zone being provided such that the head center of gravity is able to be selectively located forwardly and rearwardly and also in the lateral and vertical directions.

35. The head of claim 34 wherein said bottom wall defines a sole plate having laterally spaced wings which extend upwardly and laterally oppositely toward the heel and toe walls, and said local zone merges with said wings, laterally.

36. The head of claim 35 wherein said wings have downwardly concave lower surfaces.

* * * * *